US009085157B2

(12) United States Patent
Vodopivec

(10) Patent No.: US 9,085,157 B2
(45) Date of Patent: Jul. 21, 2015

(54) PRINTING UNIT OF THE IMPROVED TYPE AND INKJET PRINTING DEVICE COMPRISING SAID PRINTING UNIT

(71) Applicant: NEW SYSTEM S.R.L., Gorizia (IT)

(72) Inventor: Mitja Vodopivec, Faedis (IT)

(73) Assignee: NEW SYSTEM S.R.L., Gorizia (IT)

( * ) Notice: Subject to any disclaimer, the term of this patent is extended or adjusted under 35 U.S.C. 154(b) by 0 days.

(21) Appl. No.: 14/050,968

(22) Filed: Oct. 10, 2013

(65) Prior Publication Data

US 2014/0111576 A1 Apr. 24, 2014

(30) Foreign Application Priority Data

Oct. 22, 2012 (IT) ..... VI2012A0278

(51) Int. Cl.
*B41J 2/165* (2006.01)

(52) U.S. Cl.
CPC ..... *B41J 2/16523* (2013.01); *B41J 2/16552* (2013.01); *B41J 2002/16514* (2013.01); *B41J 2002/16555* (2013.01)

(58) Field of Classification Search
CPC ..... B41J 2/16523
USPC ..... 347/29–30
See application file for complete search history.

(56) References Cited

U.S. PATENT DOCUMENTS

| | | | | |
|---|---|---|---|---|
| 4,970,535 | A | 11/1990 | Oswald et al. | |
| 5,051,758 | A | 9/1991 | Markham | |
| 5,184,147 | A | 2/1993 | MacLane et al. | |
| 5,300,958 | A | 4/1994 | Burke et al. | |
| 5,444,474 | A | 8/1995 | Ohtsubo et al. | |
| 5,574,485 | A | 11/1996 | Anderson et al. | |
| 5,583,545 | A | 12/1996 | Pawlowski, Jr. et al. | |
| 5,790,147 | A | 8/1998 | Hensel | |
| 6,217,146 | B1 | 4/2001 | Takahashi et al. | |
| 6,267,464 | B1 | 7/2001 | Furlani et al. | |
| 6,343,883 | B1 * | 2/2002 | Tada et al. | 400/196 |
| 6,464,326 | B1 | 10/2002 | Weeks | |
| 6,491,387 | B1 | 12/2002 | Mayfield | |
| 6,530,643 | B1 | 3/2003 | Askren et al. | |
| 6,575,553 | B1 | 6/2003 | Williams et al. | |
| 7,419,239 | B2 | 9/2008 | Brown et al. | |
| 7,481,513 | B2 | 1/2009 | Hsieh | |
| 8,070,253 | B2 | 12/2011 | Kuroda et al. | |
| 8,211,843 | B1 | 7/2012 | Offenhartz | |
| 2003/0007029 | A1 | 1/2003 | Kotaki | |
| 2004/0046828 | A1 * | 3/2004 | Yamada et al. | 347/30 |
| 2005/0035991 | A1 | 2/2005 | Fredrickson | |
| 2006/0044376 | A1 * | 3/2006 | Baird et al. | 347/102 |
| 2006/0132556 | A1 | 6/2006 | Kooizumi et al. | |

* cited by examiner

*Primary Examiner* — Jason Uhlenhake
(74) *Attorney, Agent, or Firm* — Sughrue Mion, PLLC

(57) ABSTRACT

A printing unit is provided having a moveable printing head with a nozzle plate having a plurality of nozzles to eject liquid ink; a cleaning station having a cleaning surface with at least one suction element to generate air suction; the cleaning station configured to clean the nozzles when the printing head overlaps with the cleaning station so that the nozzle plate and the cleaning surface at least partially overlap; a movement actuator means configured to move the printing head with respect to the cleaning station between a first position in which the suction element overlaps a first end of the nozzle plate and a second position in which the suction element overlaps a second end, opposite the first end, of the nozzle plate. A proximity sensor means measures a distance between the nozzle plate and the cleaning surface.

13 Claims, 5 Drawing Sheets

Fig.1 arte nota

PRINTING UNIT OF THE IMPROVED TYPE AND INKJET PRINTING DEVICE COMPRISING SAID PRINTING UNIT

The present invention concerns a printing unit of the improved type configured to better the quality and precision of the printing head cleaning operations.

The present invention concerns also a method for carrying out the printing head cleaning operations through an improved printing unit.

The present invention further concerns also an inkjet printing device with an improved printing unit.

FIG. 1 shows a schematic illustration of a printing unit A of the currently known art.

As is known, said type of printing units A is used on inkjet printing devices configured to print legends (letters, numbers and/or geometrical shapes) on various materials such as printed circuit boards or PCBs.

Printing unit A comprises a printing head B provided with a plurality of nozzles D distributed on a nozzle plate C.

Nozzles D eject the ink in the form of drops, so as to print said legend on a printing plane on a PCB.

Typically, printing head A can move above said printing plane along two directions x and y that are orthogonal to each other, according to a predefined printing plan.

It is also known that in order to guarantee high quality and high resolution printing results over time it is necessary to keep the nozzle plate C of the printing head B constantly clean.

In fact, in order to obtain a high printing quality over time it is absolutely important to maintain a constant surface tension on the nozzle plate C for each ink drop ejected by the nozzles D.

Furthermore, in the case where the ink, usually of the UV sensitive type, that has accumulated on the nozzle plate C is not removed, it tends to polymerize, thus clogging the orifices of the plurality of nozzles D and thus preventing the ink drops from coming out of the nozzles. This phenomena may lead to a need to replace the printing head B prematurely.

In order to cope with this matter, as shown in FIG. 1, printing units A, known in the art, typically comprise a cleaning station E usually arranged at the side of the printing plane and provided with a cleaning surface F on which there is a cleaning element G configured to remove the excess ink from the nozzle plate C of the printing head B. In the printing unit shown in FIG. 1, said cleaning element G is a suction element G configured to generate a suction of the air from outside of the cleaning surface F.

In particular, said suction element G comprises a nozzle H having its orifice arranged on the plane defined by the cleaning surface F and connected, on the opposite side, to a Venturi vacuum pump I so as to draw towards the inside the air present above said cleaning surface F, as shown by the arrows N in FIG. 1.

In order to clean the nozzle plate C, the printing head B, at regular time intervals between a printing operation and the following one, is arranged above the cleaning station E, in such a way that the nozzle plate C of the same printing head B and the cleaning surface F of the cleaning station E face each other at a predefined distance L.

Successively, the cleaning operation includes the translation of the cleaning station. E with respect to the printing head B from a first cleaning position, in which the suction element G is superimposed to a first end of the nozzle plate C, to a second position, in which the same suction element G is superimposed on a second end of the nozzle plate C, opposite the first end of nozzle plate C.

FIG. 1 shows the axis a of translation of the cleaning station E with respect to the printing head B.

Successively the cleaning operation includes the translation of the cleaning station E in the opposite direction, that is, from the second position to said first position.

During the motion in both directions, the suction element G progressively draws the air under the individual nozzles D distributed along the nozzle plate C, removing the excess ink from them.

However, said printing unit A of the known art poses a series of drawbacks.

First of all, it is important to underline that during the cleaning operation the distance L between the nozzle plate C and the cleaning surface F plays a fundamental role for the cleaning quality of the nozzles D and, consequently, for the quality of the printing operation carried out successively.

It is known, in fact, that to obtain high quality cleaning results the ideal distance L between said two surfaces is less than 300 micrometres, and it is preferably 250 micrometres.

A first drawback posed by printing unit A of the known art lies in that said distance L is set and accurately controlled by specialized staff only on installation and setting of the printing device, using suitable setting instruments.

After said setting step, the printing unit A of the known art does not make it possible to determine the value of said distance L precisely and to identify any variation in the same distance. As a matter of fact, during the operation of the printing device distance L may vary due to several factors.

For example, distance L may vary because of climatic changes in the environment surrounding the printing device, in particular because of a decrease or increase in the ambient temperature and thus in the temperature of the components of the printing unit A.

Furthermore, distance L may accidentally vary as a result of ordinary maintenance operations on the printing unit A.

The variation of distance L may also be caused by the vibrations generated by the same printing device or by devices arranged near the printing device.

As a result of the above, two important drawbacks may occur.

If distance L is too high, the nozzles D will not be cleaned properly, as the suction of the air generated by the suction element G will not be sufficient to draw all the ink accumulated on the nozzle plate C. Consequently, said non-optimal cleaning leads to worse printing quality and even to the polymerization of the excess ink, which in turn leads to the need to replace the printing head B.

On the other hand, if said distance L is too small, during said translation, the printing head B and the cleaning station E might come in contact with each other and even damage each other.

A further parameter that contributes to determining the quality of the cleaning operation carried out on the nozzle plate C is the speed at which the cleaning station E is translated with respect to the printing head B.

In fact, the choice of the speed value consequently determines the duration of the lapse of time during which the suction element G carries out the suction operation under each individual nozzle D belonging to the plurality of nozzles D of the nozzle plate C.

In particular, it is well known that the optimal speed value to obtain high quality cleaning results and sufficiently short cleaning times is approximately 30 mm/s.

To disadvantage, the printing units A of the known type do not allow setting keeping it constant over time.

Another drawback of the printing units A of the known art lies in that it is extremely difficult to find a compromise between quality of cleaning and overall system throughput (cleaning time).

The present invention aims to overcome the drawbacks listed above. In particular, it is the object of the invention to provide a printing unit that is capable of guaranteeing a higher cleaning quality of the nozzle plate over time than the printing units of the known art.

It is also the object of the invention to provide a printing unit that makes it possible to guarantee a high printing quality over time.

For this purpose, it is the object of the invention to provide a printing unit that is capable of controlling the optimal conditions for cleaning the nozzle plate and of keeping them constant over time.

It is a further object of the invention to provide a printing unit that is able to avoid accidental impacts between the printing head and the cleaning station during the execution of the cleaning operation.

It is also the object of the invention to provide a printing unit that makes the optimized compromise between cleaning quality and overall system's throughput easier than the printing units of the known art.

The objects described above are achieved by a printing unit having the characteristics illustrated in the main claim.

Said objects are also achieved by a method for carrying out the printing head cleaning operation through said printing unit.

Furthermore, said objects are also achieved by a printing device comprising said printing unit.

To advantage, knowing constantly, during the cleaning operations, the precise value of the distance between the printing head and the cleaning station makes it possible to considerably reduce the risk of damaging the printing unit due to accidental impacts and thus makes it possible to reduce maintenance on and replacement of the components of the printing unit.

Consequently, reducing the interventions of specialized staff allows maintenance costs to be reduced.

Still advantageously, in certain circumstances measuring constantly and precisely the value of said distance allows the printing unit to perform an automatic setting of the position of the printing head and/or the cleaning station, so as to restore the value of said distance and keep it constant within a pre-established value interval.

Finally, advantageously and surprisingly, the possibility to vary and adjust in a precise manner the translation speed of the cleaning station with respect to the printing head has made it possible to find out that if said translation is slowed down to a value of approximately 3-5 mm/s, the suction operation performed by the suction element makes it possible to remove also the so-called "mist" from the nozzle plate in an optimal and automatic way, "mist" meaning the clouds of micro drops that are generated when an ink drop comes out of the nozzles of the nozzle plate.

Said micro drops, in fact, have a radius that is more than ten times smaller than the radius of the printing ink drop and a weight that is even one thousand times lower that the weight of a printing ink drop. Due to said physical characteristics and to the effects of UV light, to disadvantage, said micro drops tend to deposit and polymerize on the nozzle plate C.

At present, to avoid said polymerization, even if the printing units A of the known art have a cleaning station E, it is however necessary to stop the printing device every 4-8 hours to remove said "mist" from the nozzle plate C manually.

If this special manual cleaning operation were not carried out, it would be necessary to replace the printing head B.

It is clear, therefore, that thanks to the possibility to carry out said so-called "slow" cleaning, it is advantageously possible to avoid the drawbacks due to the accumulation of mist on the nozzle plate.

The objects and advantages described above will be highlighted in greater detail in the description of preferred embodiments of the invention that is provided as an indicative, non-limiting example, with reference to the enclosed drawings, wherein.

Figure 1:
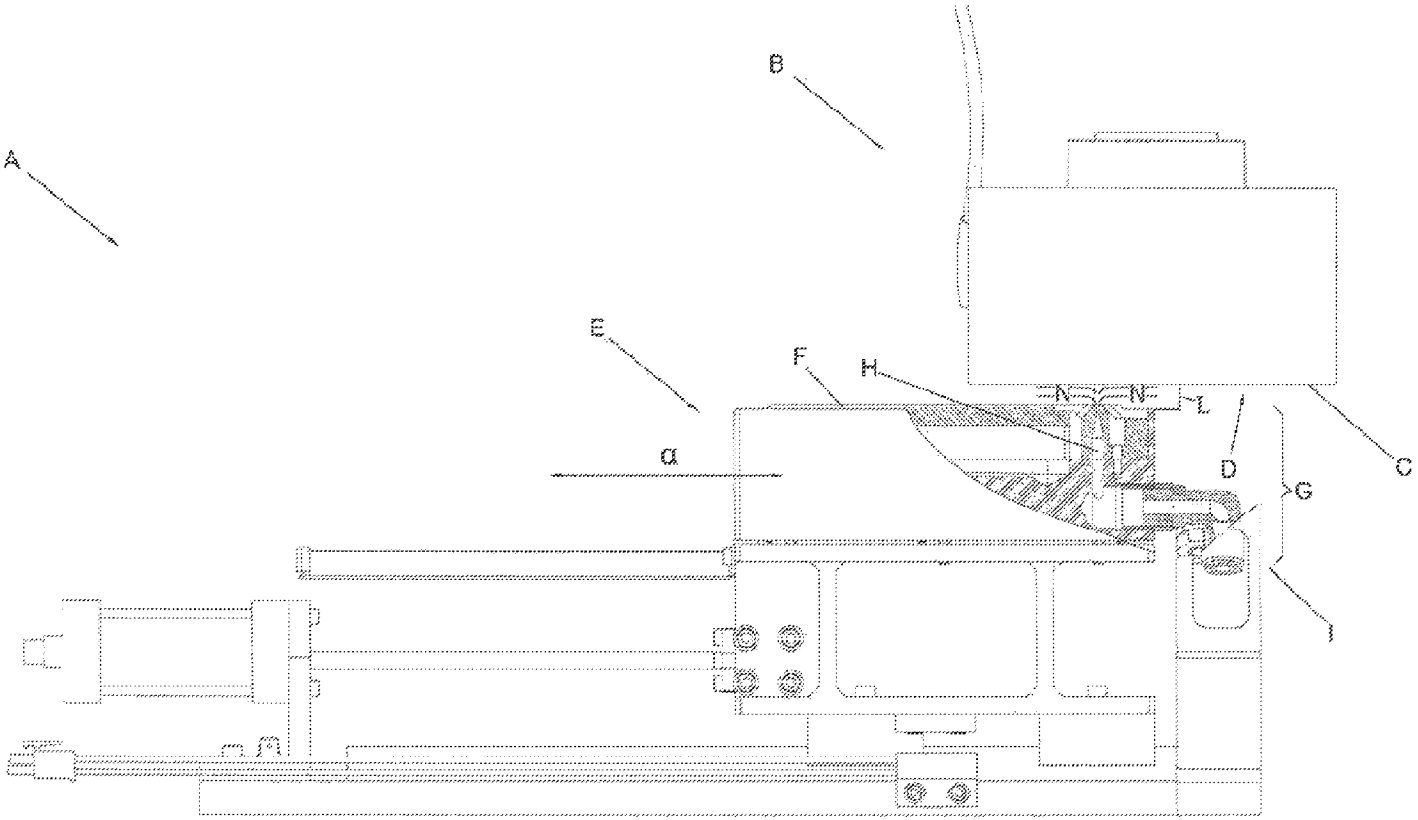
FIG. 1 shows a side view of a printing unit according to the known art.
Figure 2:
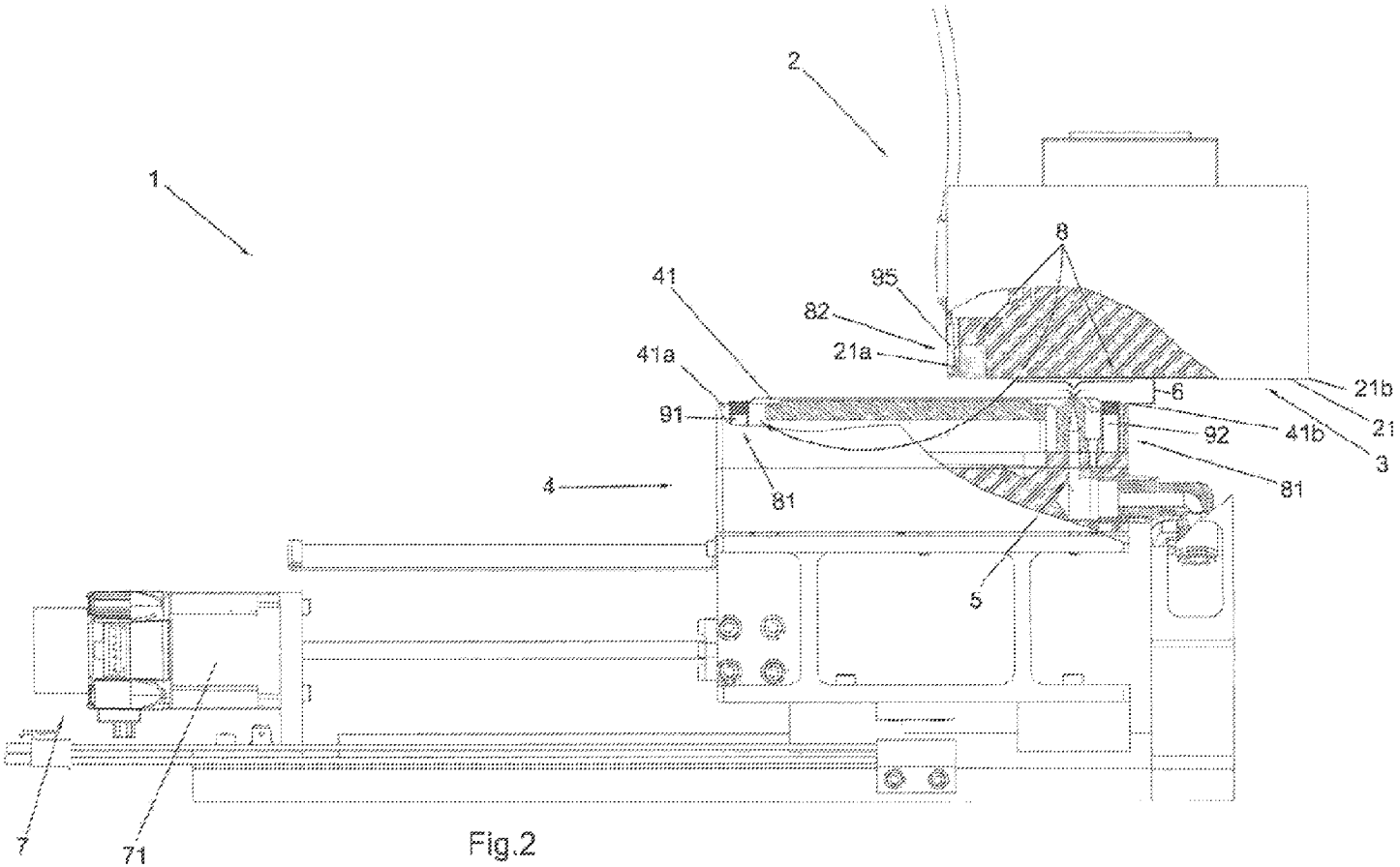
FIG. 2 shows a side view of the printing unit according to an embodiment of the invention.

The printing unit of the invention is illustrated as a whole in FIG. 2, where it is denoted by 1.

As shown in FIG. 2, the printing unit 1 comprises a movable printing head 2 provided with a nozzle plate 21 which has a plurality of nozzles 3, from which the printing ink is ejected typically in the form of drops.

Figure 3:
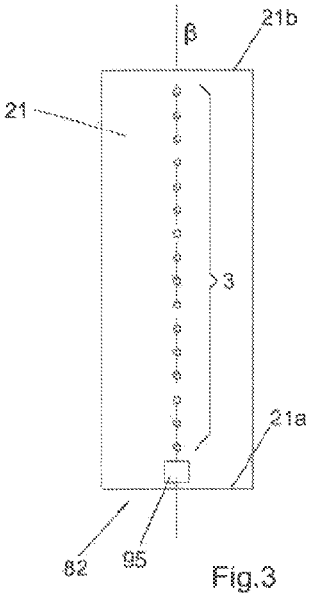
FIGS. 3 and 4 show the nozzle plate and the cleaning surface according to a first embodiment of the printing unit of the invention.

According to a preferred embodiment of the invention, nozzles 3 are arranged in a single row parallel to the longitudinal axis β of the nozzle plate 21, as shown in FIG. 3.

Figure 5:
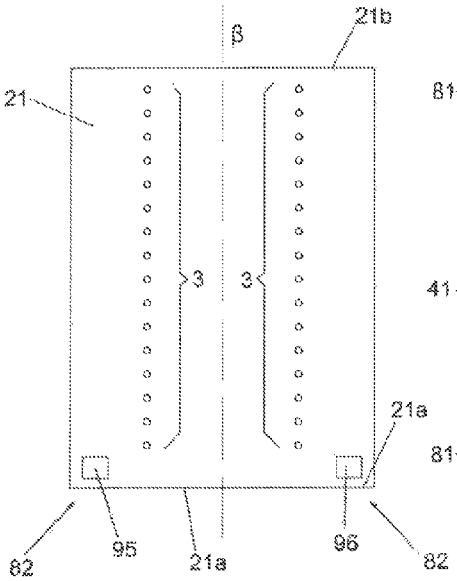
FIGS. 5 and 6 show the nozzle plate and the cleaning surface according to a second embodiment of the printing unit of the invention.

According to another embodiment nozzles 3 are arranged in two rows parallel to each other and parallel to said longitudinal axis β of the nozzle plate 21, as shown in FIG. 5.

It cannot be excluded, however, that in alternative embodiments of the invention nozzles 3 are arranged along the nozzle plate 21 in different ways with respect to the two embodiments described above.

As mentioned above, printing head 2 can move along two directions x and y orthogonal to each other above a printing plane, (not shown in FIGS. 2-8) where, for example, a printed circuit board is arranged.

Printing unit 1 also comprises, as shown in FIG. 2, a cleaning station 4 provided with a cleaning surface 41. The cleaning station 4 is usually positioned in the printing device beside the printing plane.

Figure 4:
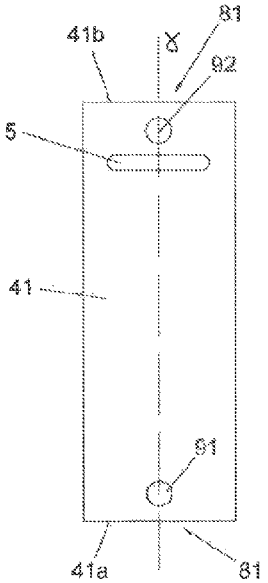

As shown in FIG. 4, according to a preferred embodiment of the of the invention, the cleaning surface 41 comprises a single suction element 5 configured to generate a suction of the air from the outside of the cleaning surface 41.

Figure 6:
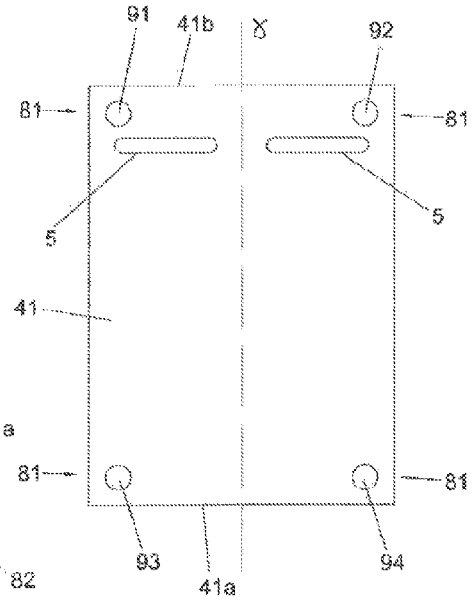

According to another alternative embodiment of the invention, as shown in FIG. 6, cleaning surface 41 comprises two suction elements 5 arranged side by side along a direction that is orthogonal to the longitudinal axis y of the cleaning surface 41, so that, during the cleaning operation, each one of said suction elements 5 is configured to draw the excess ink from one of the two rows of nozzles 3 of the second embodiment shown in FIG. 5.

Said cleaning operation is carried out on the nozzle plate 21 when the printing head 2 is arranged at least partially overlapping the cleaning station 4, so that the nozzle plate 21 and the cleaning surface 41 face each other at least partially at a predefined distance 6.

Preferably but not necessarily, distance 6 is between 150 and 300 micrometers.

According to a preferred embodiment of the invention, distance 6 is 250 micrometers.

Figure 7:
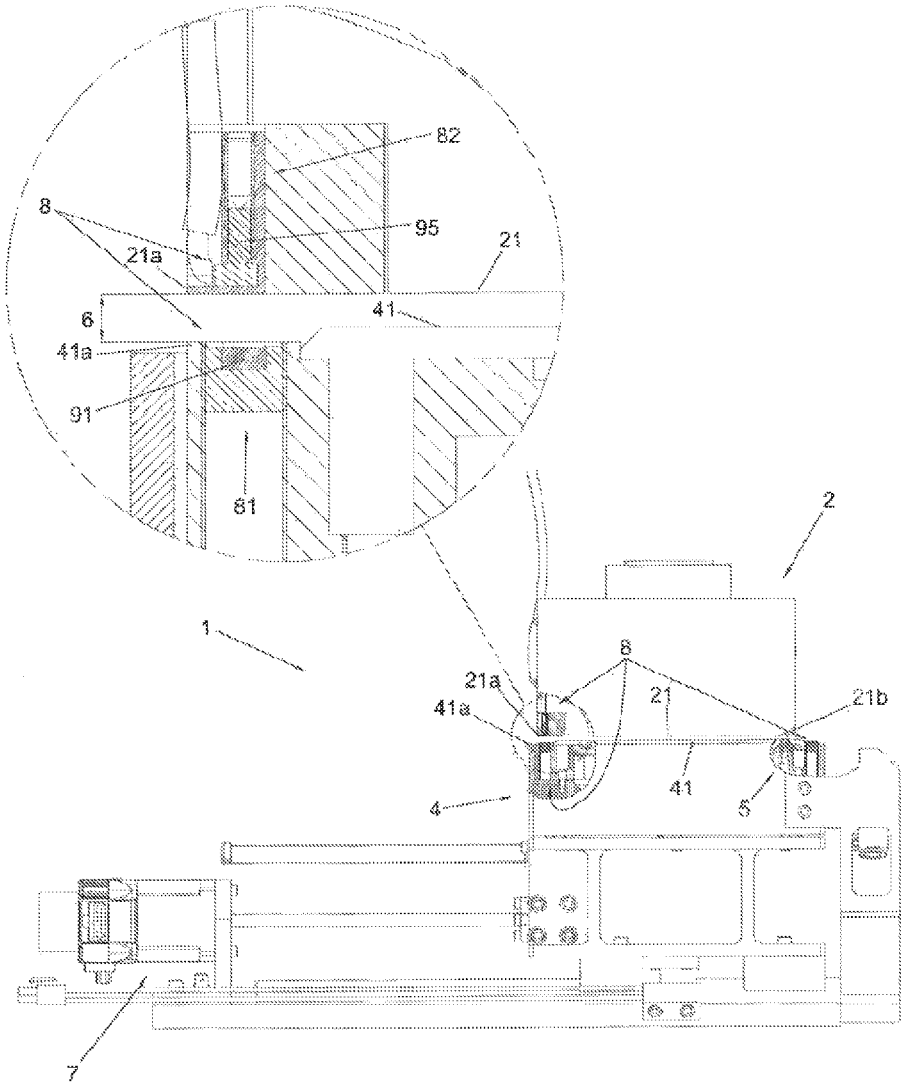
FIGS. 7 and 8 show the printing unit according to an embodiment of the invention respectively in the first and in the second position.

The printing head 2 and the cleaning station 4, preferably but not necessarily, are completely superimposed to each other, therefore the nozzle plate 21 and the cleaning surface 41 face each other completely, as shown in FIG. 7.

Figure 8:
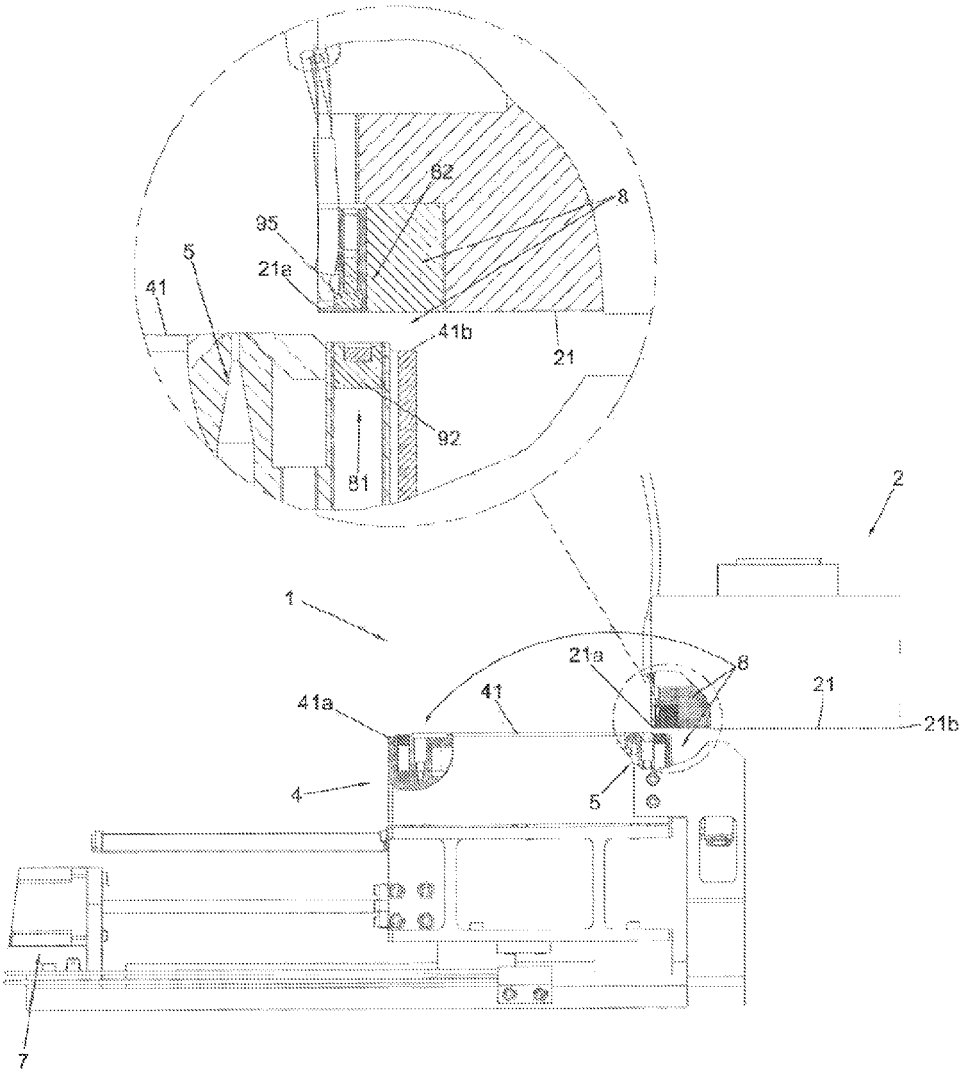

When the printing head 2 is superimposed to the cleaning station 4, the latter, through movement actuator means 7 belonging to the printing unit 1, is translated with respect to the printing head 2 from a first position, in which the suction element 5 is superimposed to a first end 21*b* of the nozzle plate 21, to a second position, in which the suction element 5 is superimposed to a second end 21*a* of the same nozzle plate 21, opposite the first end 21*b*, as respectively shown in FIGS. 7 and 8.

The cleaning operation includes also the successive translation of the cleaning station E in the opposite direction, that is, from the second position to the first position.

During these translation movements, the suction element 5 progressively draws the excess ink present on the nozzle plate 21 in the proximity of nozzles 3.

According to an embodiment of the invention the nozzle plate 21 and the cleaning surface 41 are provided with proximity sensor means 8 that are capable of measuring the value of the distance 6.

In particular, according to a preferred embodiment of the invention said proximity sensor means 8 are configured to measure said distance 6 at the level of the first position and at the level of said second position as defined above, during the cleaning operation, as shown in the details of FIGS. 7 and 8.

In this way it is possible to understand if there has been no variation in the distance 6 in both positions compared to the values set at the beginning, if there has been a variation in the distance 6 in one of the two positions or if there has been a variation in the value of the distance 6 in both said positions.

From an operational point of view, the printing unit 1 of the invention makes it possible to determine the mutual position of the printing head 2 and of the cleaning station 4 and in the case where there is a variation in the distance 6 compared to the value set at the beginning, the printing unit 1 of the invention intervenes and signals the anomaly to the operator through suitable alarm systems or by modifying automatically, with a suitable feedback control, the position of the printing head 2 and/or of the cleaning station 4, so as to restore said distance 6 to the value set during the setting step.

Said two types of intervention depend on the type and extent of the variation in the distance 6 and thus on the causes of said variation. According to preferred embodiments of the invention shown in FIGS. 2, 3 and 4, said proximity sensor means 8 comprise two emitter elements 81 arranged on the two opposite ends 41*a* and 41*b* of the cleaning surface 41 and comprise a measuring element 82 arranged on the end 21*a* of the nozzle plate 21, in such a way as to measure the value of said distance 6 at the level of the first and of the second position as defined above.

In particular, according to a preferred embodiment of the invention, said emitter elements 81 are two permanent magnets 91 and 92, while the measuring element 82 is a Hall effect proximity sensor 95, as shown in FIGS. 2, 3 and 4.

In an alternative embodiment, the two emitter elements 81, and in particular the two permanent magnets 91 and 92 may be arranged on the two opposite ends 21*a* and 21*b* of the nozzle plate 21, while the measuring element 82, in particular the Hall effect proximity sensor 95, may be arranged on the end 41*b* of the cleaning surface 41, provided that it is possible to measure the value of the distance 6 in both said positions.

According to a second embodiment of the invention shown in FIGS. 5 and 6, the proximity sensor means 8 comprise four emitter elements 81, in particular four permanent magnets 91, 92, 93 and 94, arranged on the four corners of the cleaning surface 41 and furthermore comprise two measuring elements 82, in particular two Hall effect sensors 95 and 96 arranged on the two corners of the end 21*a* of the nozzle plate 21.

In this way it is possible to measure the values of said distance 6 in four points in space, allowing the printing unit 1 of the invention to measure also the side inclination of the nozzle plate 21 with respect to the cleaning surface 41 and vice versa.

It cannot be excluded, however, that in alternative embodiments of the invention the proximity sensor means 8 of the printing unit 1 of the invention could comprise a proximity sensor of the inductive type, an ultrasonic proximity sensor or a proximity sensor of any other type.

It should be mentioned that the use of proximity sensors means 8 such as Hall effect sensor or such as proximity sensor of the inductive type advantageously makes it possible to obtain an extremely precise measurement of the distance 6 between the printing head 2 and the cleaning station 4, during both the setting step and the measuring step of the cleaning operation.

It cannot be excluded, also, that alternative embodiments of the invention differ with respect to those described above for the fact that the proximity sensor means 8 are configured to simultaneously measure the distance 6 in at least two different points of the nozzle plate 21 mutually spaced in the direction of the longitudinal axis β of the nozzle plate 21.

According to an embodiment of the invention, the movement actuator means 7 are operatively associated with the cleaning station 4 in order to translate it with respect to the printing head 2.

Alternatively, the movement actuator means 7 may be operatively associated with the printing head 2 in such a way as to translate the latter with respect to the cleaning station 4.

In both of the cases described above, further improvement of the precision of the measurement of the distance 6, may be achieved by having the movement actuator means 7 constituted by NC electric actuator means, in particular a NC electric motor 71.

In particular, advantageously, the use of a NC electric motor 71 makes it possible to determine precisely the mutual positions assumed by the printing head 2 and the cleaning station 4 during both the setting and the measurement steps.

It is thus possible to obtain high repeatability of the conditions for the measurement of the distance 6, thus making it possible to precisely determine any variation between the values of said distance 6 set in the setting step and those measured during the cleaning operation. Furthermore, as already explained above, the inventors have found out, following test performed that the use of a NC electric motor 71 has advantageously made it possible to reduce the translation speed of the cleaning station 41 considerably, while at the same time maintaining it uniform.

As a result of the above, the inventors found out that at a reduced translation speed, in particular between 3 and 5 mm/s, the suction ensured by the suction element 5 is capable of removing also said "mist" from the nozzle plate 21 in an optimal manner.

It cannot be excluded, however, that in alternative embodiments of the printing unit 1 of the invention, the movement actuator means 7 may be of a type different from a NC electric motor 71, provided that they can determine precisely the mutual positions assumed by the printing head 2 and the cleaning station 4.

The present invention concerns also the method for carrying out the printing head cleaning operation through the printing unit 1 of the invention.

In particular, the method comprises the step of arranging the printing head 2 at least partially overlapping the cleaning station 4, so that the nozzle plate 21 and the cleaning surface 41 face each other at least partially at a predefined distance 6.

Subsequently, the method envisages to perform the relative translation of the printing head 2 and the cleaning station 4 from a first position, in which the suction element 5 is superimposed to a first end 21*b* of the nozzle plate 21, to a second position, in which the suction element 5 is superimposed to a second end 21*a*, opposite said first end 21*b*, of the nozzle plate 21 and vice versa, so as to carry out said cleaning operation.

According to the invention, the method comprises the step of measuring the distance 6 in the first position and in the second position during said cleaning operation.

Finally, the present invention concerns also a printing device of the type inkjet, not illustrated in the figures, comprising the printing unit 1 of the invention, for printing legends on the surfaces of printed circuit boards.

It is therefore clear, according to the above description, that the printing unit, the method and the printing device carried out according to the invention achieve all the set objects.

In particular, the invention achieves the object to provide a printing unit that is capable of guaranteeing a higher cleaning quality of the nozzle plate over time than the printing units of the known art.

Consequently, the invention also achieves the object to provide a printing unit that makes it possible to guarantee a high printing quality over time.

The invention furthermore achieves the object to provide a printing unit that is capable of controlling the distance between the printing head and the cleaning station during the cleaning of the nozzle plate and of keeping it constant over time.

The invention also achieves the object to provide a printing unit that is capable of performing the relative translation between the printing head and the cleaning station at a specific speed that is constant over time.

The invention also achieves the object to provide a printing unit that is able to avoid accidental impacts between the printing head and the cleaning station during the execution of the cleaning operation.

Finally, the invention also achieves the object to provide a printing unit that makes the optimized compromise between cleaning quality and overall system's throughput easier than the printing units of the Known art.

The invention claimed is:

1. A printing unit, comprising:

a movable printing head comprising a nozzle plate comprising a plurality of nozzles configured to eject liquid ink;

a cleaning station comprising a cleaning surface comprising at least one suction element configured to generate a suction of air, said cleaning station being configured to clean said plurality of nozzles of said printing head when said printing head is in a cleaning region in which said printing head overlaps at least partially with said cleaning station, so that said nozzle plate and said cleaning surface face each other at least partially at a predefined distance;

movement actuator means configured to perform the relative translation of said printing head and said cleaning station from a first position, in which said suction element is superimposed with a first end of said nozzle plate, to a second position, in which said suction element is superimposed with a second end, opposite said first end, of said nozzle plate and vice versa, thereby carrying out said cleaning operation, and proximity sensor means configured to measure a distance between said nozzle plate and said cleaning surface in at least said first position and said second position during said cleaning operation.

2. The printing unit according to claim 1, characterized in that said proximity sensor means comprises at least one emitter element arranged on said first end of said nozzle plate, at least one emitter element arranged on said second end of said nozzle plate, and at least one measuring element arranged on one end of said cleaning surface.

3. The printing unit according to claim 1, characterized in that said proximity sensor means comprises at least one emitter element arranged on a first end of said cleaning surface, at least one emitter element disposed on a second end of said cleaning surface, opposite said first end, and at least one measuring element arranged on one of said first end of said nozzle plate and said second end of said nozzle plate.

4. The printing unit according to claim 3, characterized in that each of said emitter elements is a permanent magnet and said at least one measuring element is a Hall effect proximity sensor.

5. The printing unit according to claim 1, wherein said proximity sensor means comprises:

four permanent magnets arranged on four corners of one of said nozzle plate and said cleaning surface, and two Hall effect proximity sensors arranged on two corners of one end of one of said cleaning surface and said nozzle plate.

6. The printing unit according to claim 1, wherein said proximity sensor means comprises a proximity sensor of the inductive type.

7. The printing unit according to claim 1, wherein said proximity sensor means comprises an ultrasonic proximity sensor.

8. The printing unit according to claim 1, wherein said proximity sensor means is configured to simultaneously measure said distance at least two different points of said nozzle plate mutually spaced in a direction of a longitudinal axis of said nozzle plate.

9. The printing unit according to claim 1, wherein said movement actuator means is configured to move said cleaning station, with respect to said printing head, from said first position to said second position.

10. The printing unit according to claim 1, wherein said movement actuator means is an NC electric movement actuator means.

11. The printing unit according to claim 10, wherein said NC electric movement actuator means is an NC electric motor.

12. A printing device of the type ink jet for printing on the surfaces of electronic circuit boards, comprising the printing unit according to claim 1.

13. A printing head cleaning method, comprising:

arranging a moveable printing head into a cleaning region in which the printing head at least partially overlaps with the cleaning station, so that a nozzle plate of the printing head and a cleaning surface of the cleaning station face each other at least partially at a predefined distance;

performing a cleaning operation comprising:

performing a relative translation of said printing head and said cleaning station from a first position, in which a suction element of the cleaning surface of the cleaning station is superimposed with a first end of said nozzle plate, to a second position, in which said suction element is superimposed with a second end, opposite said first end, of said nozzle plate and vice versa, thereby carrying out a cleaning operation, and measuring a distance between said nozzle plate and said cleaning surface in said first position and in said second position.

* * * * *